US005294941A

United States Patent [19]

Yamada et al.

[11] Patent Number: 5,294,941

[45] Date of Patent: Mar. 15, 1994

[54] RECORDING APPARATUS

[75] Inventors: Masakatsu Yamada; Minoru Yokoyama, both of Yokohama, Japan

[73] Assignee: Canon Kabushiki Kaisha, Tokyo, Japan

[21] Appl. No.: 911,483

[22] Filed: Jul. 10, 1992

[30] Foreign Application Priority Data

Jul. 29, 1991 [JP] Japan ..... 3-188496

[51] Int. Cl.[5] ..... B41J 2/32

[52] U.S. Cl. ..... 346/76 PH

[58] Field of Search ..... 346/76 PH

[56] References Cited

U.S. PATENT DOCUMENTS 4,862,193 8/1989 Hattori et al. ..... 346/76 PH
5,112,255 5/1992 Kobayashi et al. ..... 346/76 PH
5,122,882 6/1992 Ishida et al. ..... 358/296
5,179,390 1/1993 Yokoyama et al. ..... 346/76 PH

FOREIGN PATENT DOCUMENTS 0225582 6/1987 European Pat. Off. ..... 346/76 PH

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A recording apparatus having a sensor for detecting the presence or absence of a recording medium and a head for recording data on the recording medium transferred along a guide member forming a part of a delivery passage. Space availability for the sensor and the guide member is enhanced through curtailment of the number of parts which is attained by integrally forming the sensor and the guide member.

14 Claims, 2 Drawing Sheets

RECORDING APPARATUS

BACKGROUND OF THE INVENTION

1. Field of the Invention

The present invention relates to a recording apparatus for performing recording by means of a recording head on a recording medium transferred along a conveyance route.

2. Related Background Art

In a conventional recording apparatus such as a printer or the like which transfers a recording paper and records signals thereon, a recording paper sensor has generally been utilized for detecting the presence or absence of the recording paper (sheet) on the passage along which it is conveyed FIG. 2 shows a schematic sectional view illustrating a constitution of a recording block in such a conventional printer. In FIG. 2, a thermal head 31 is provided with a plurality of heating elements each heat-driven in accordance with an image signal, thereby permitting recording on the recording paper such as thermosensitive paper and others. The recording paper is sandwiched between a platen roller 32 and a thermal head 31 and conveyed forwardly as the platen roller 32 is rotated in the direction of an arrow "A". A spring 33 is used to press the thermal head 31 against the platen roller 32. A recording paper sensor 34 for detecting the presence or absence of the recording paper is located along the conveyance route for the recording paper and before the recording position by the thermal head 31. A recording paper guide 35 forms a conveyance route for the recording paper and a part of a frame 38 also forms the conveyance route by opposing the recording paper guide 35. The recording paper is inserted through an inlet 36 into the conveyance route and discharged through an outlet 37 out of the apparatus.

The operation of the conventional recording apparatus as constructed above will be hereinafter explained.

When the commencement of print operation is directed by an external device such as a host computer or the like not shown in the drawing, it is determined in response to a signal from the recording paper sensor 34 whether or not the recording paper is present, before the start of the recording operation. With the recording paper present, the platen roller 32 is rotated in the direction of an arrow "A" and the recording paper begins to be conveyed. Simultaneously with this, the heating elements of the thermal head 31 are driven respectively based on the recording information (image data) transmitted from an external device to effect recording on the recording paper. The recording paper on which the image data were printed as previously described is ejected from the outlet 37 toward the outside. Contrary to this, if it is judged based on the signal from the sensor 34 that the recording paper is not present, the platen roller 32 is not rotated. Instead, it is indicated on a display (not shown) that the recording paper is not present on the conveyance route or that the apparatus is not provided with paper.

As clearly understood from the foregoing in the conventional apparatuses, it is required to provide the recording paper sensor for detecting the presence or absence of the recording paper in the conveyance route upstream of a recording position. Accordingly, it will be necessary to have a space and parts for disposing such a sensor, thus causing the problems indicated below.

(i) There is a limitation completing making the apparatus compact, since a suitable space for mounting the sensor in the conveyance route is required.

(ii) Workability and assembly are complicated because additional procedures for mounting the sensor on the conveyance route are required.

(iii) Cost of the apparatus rises due to the cost of the fittings used for mounting the sensor.

SUMMARY OF THE INVENTION

With the foregoing situation in view, the present invention has as its primary object the provision of a recording apparatus in which the space available for the sensor and the guide member is enhanced by employing a guide member integrally formed with the sensor to detect the presence or absence of a recording medium and thereby reduce the number of parts used.

In order to accomplish the aforesaid and further objects of the present invention which will become more apparent as the following description proceeds, the recording apparatus in accordance with the subject invention is constructed as follows. That is, the gist of the subject invention resides in a recording apparatus provided with a head permitting recording on a recording medium conveyed along a conveyance route to be characterized by comprising a guide member for forming the conveyance route and guiding the recording medium over the conveyance route, and a sensor integrally formed with the guide member for detecting the presence or absence of the recording medium on the conveyance route.

As described above, an improvement in the availability of space for the sensor and the guide member due to a reduction in the number of parts can be effectively achieved by integrally constructing the guide member for forming the conveyance route to the recording medium and guiding the recording medium over the conveyance route, and the sensor for detecting the presence or absence of the recording medium on the conveyance route.

DESCRIPTION OF THE PREFERRED EMBODIMENTS

Preferred embodiments of this invention will be explained by referring the accompanying drawings.

Figure 1:
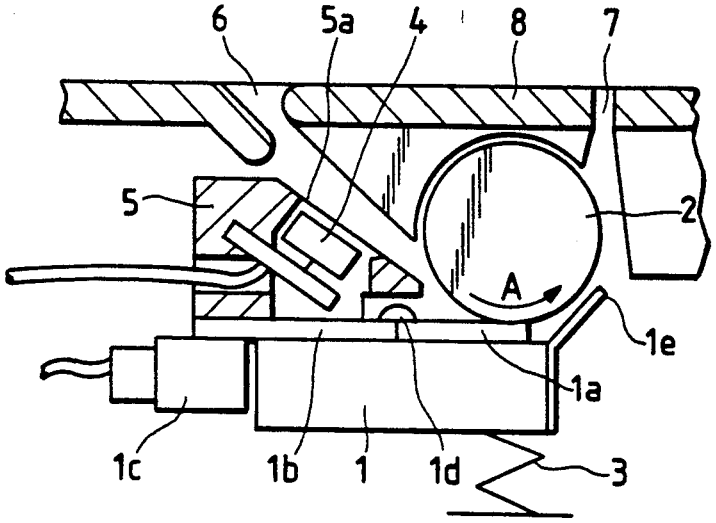
FIG. 1 is a side sectional view illustrating a schematic construction for a recording block of a recording apparatus according to the present invention.
Figure 2:
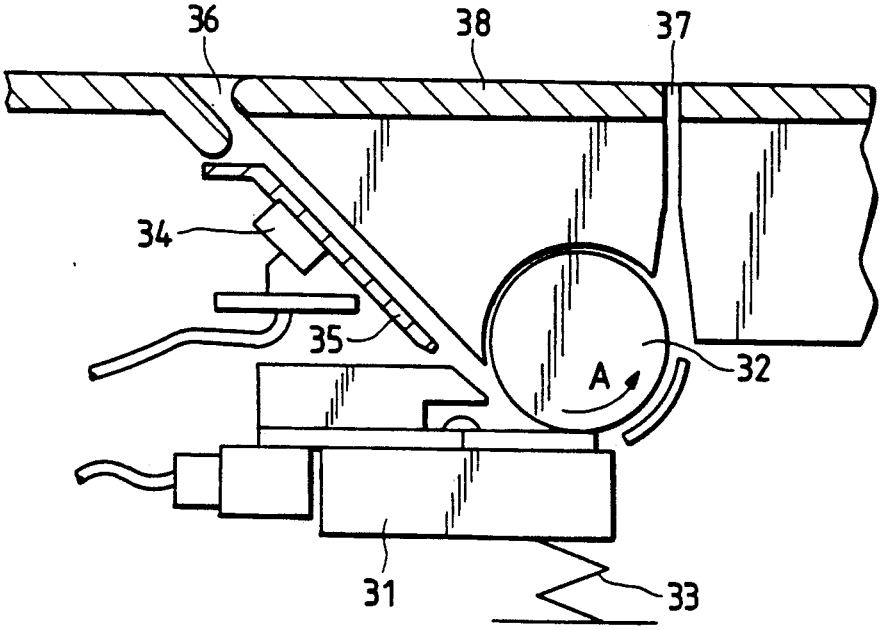
FIG. 2 is a schematic sectional view representing a construction of a recording section of the conventional recording apparatus.

Referring now particularly to FIG. 1, there is shown a side sectional view of a structure for a recording section of a thermo-sensitive type printer according to the present embodiment.

In FIG. 1, a thermal head 1 is provided with a plurality of heat generating elements (element) energized in accordance with image data to perform recording of images on the recording paper or sheet such as thermosensitive paper or the like. The recording sheet is held sandwiched between the thermal head 1 and a platen roller 2 and the platen roller 2 rotates in the direction indicated by an arrow "A" to convey the recording sheet to an exhausting port 7. The thermal head 1 is biased by a spring 3 A reflective type recording sheet sensor 4 is used to detect the presence or absence of the recording sheet. A protective cover 5 forms a part of the delivery passage for the recording sheet and protects a circuit substrate 1*b* for the thermal head 1. The recording paper is inserted into the delivery passage at an insertion inlet 6 and is discharged from the discharge port 7. A reference numeral 8 shows a frame of the apparatus.

The thermal head 1 comprises a ceramic substrate la having a plurality of heat generating elements, the circuit substrate lb with a circuit used for energizing the heat generating elements, and a connector 1*c* used for inputting image data and so on from a controller (not shown). The ceramic substrate la is connected to the circuit substrate 1*b* through a wire bonding portion 1*d*. The recording sheet, after having been recorded, is guided by a common cover 1*e*.

In order to protect the circuit substrate 1*b* and the wire bonding portion 1*d* of the thermal head 1 and form a part of the conveyance route for the recording sheet, the protective cover 5 is attached to the thermal head 1. In addition, the protective cover 5 is provided with an aperture 5*a* used for irradiating the recording sheet with light from the sensor 4 in the middle of the conveyance sheet, and for admitting the reflected light into the sensor. The recording sheet sensor 4 in this embodiment is secured integrally in the interior of the protective cover 5.

As clearly understood from the foregoing, since all parts around the recording sheet sensor 4 are integrated, the number of parts can be reduced and the overall structure of the apparatus can be minimized and made compact.

Although the present invention has been described with regard to the preferred embodiment thereof in which the protective cover 5 is secured to the thermal head 1, it will be understood to those skilled in the art that the present invention is not limited thereto. For example, the protective cover 5 need not be fixed to the thermal head 1, but may be coupled to any other portion of the housing. However, integral attachment of the protective cover 5 to the thermal head 1 is most reliable in view of the protection of the circuit substrate 1*b* and the wire bonding portion 1*d*.

Fundamental operation of the printer in this embodiment is the same as that of the conventional printer, but it differs depending on a recording sheet used, namely, cut sheet or roll sheet (1) Cut sheet There may be two methods for setting the cut sheet. In the first method, the cut sheet is inserted into the insertion inlet 6 after releasing pressure of the thermal head 1 against the platen roller 2 by means of a releasing mechanism (not shown). The releasing mechanism is settled at its original state when the leading end of the cut sheet reaches the discharging port 7, thereby allowing the pressure of the head 1 to be applied to the platen roller 2. In this case, the cut sheet may be inserted in an inclined state so that the cut sheet skews. In addition, in case the distance from a recording position at which the thermal head 1 contacts the platen roller 2 to the discharging port 7 is long, a blank to the end of the cut sheet becomes long, so that an effective length which can be used to record in one sheet of paper will become relatively short.

Accordingly, the following method is effective in the case of the cut sheet. First the cut sheet is inserted until it abuts against the recording position at which the thermal head 1 is in contact with the platen roller 2. Such abutment of the end of the recording sheet against the contacted portion between the thermal head 1 and the platen roller 2 enables the end of the cut sheet to be placed perpendicular to the platen roller 2, thereby preventing the recording sheet from skewing In this case, the presence of the cut sheet is detected by the sensor 4 when the cut sheet is inserted through the insertion port 6 and has passed through the sensor 4. Then, the platen roller 2 is rotated by a predetermined amount "x" in the direction indicated by the arrow "A" in during a period of approximately 0.5–1 sec. after the detection of the cut sheet in order to cause it to have a margin until the end of the cut sheet reaches the recording position Thus, the end of the cut sheet is seized between the thermal head 1 and the platen roller 2. Since the length obtained by rotation of the platen roller 2 by the amount "x" in the direction "A" becomes the blank for the end of the cut sheet, the length of the blank for the tip of the cut sheet can be adjusted by selecting the amount of "x". Successive recording operation can be started after the cut sheet has been set through such processes as described above.

During the recording operation, the platen roller 2 is rotated in the direction "A" to feed the cut sheet. Synchronously with the feeding of the recording sheet, the heat generating elements of the thermal head 1 are energized or heat-driven based on the information to be recorded, and the image data are thereby recorded on the recording paper.

After recording of image data is conducted as explained above and the rear end of the cut sheet has passed through the sensor 4, the paperless condition will thereby be detected (no sheets exist at the sensor 4) and the ejection of the recorded cut sheet will be implemented by rotation of the platen roller 2 by the amount corresponding to the distance from the sensor 4 up to the recording position by mean of the thermal head 2.

As described above, in the case of the cut sheet, the sensor 4 may detect both forward and rear ends of the cut sheet. The advantages of this case reside in that the forward and rear ends of the cut sheet can be more accurately grasped or detected than the conventional case in which the thermal head 1 and the sensor 4 are individually constituted, since the distance from the position of the sensor 4 up to its recording position can be kept constant independently of deviation of the mounting position for the thermal head 1 and the like.

(2) Roll sheet

Since a forward end of roll sheet is not always cut at a right angle to the direction of conveyance, it is necessary to set the roll sheet after releasing the pressure of the thermal head 1 against the platen roller 2. For this reason, the pressure of the thermal head 1 must be first released to permit insertion of the forward end of the roll sheet from the insertion port 6 up to the exhausting port 7 and is thereafter applied again to the platen roller 2. In such a roll sheet as described above, since the discharging port 7 corresponds to the cutting position thereof, it may be cut off by hand, for example. (The setting of the roll sheet is required only when it is replaced, but is not necessary for any page on and after the second sheet of paper.)

In this case, the sensor 4 discriminates the presence/absence of the recording sheet, but is not used to detect the forward and rear ends thereof. When the setting of the roll sheet is finished, the output of the sensor 4 indicates that the recording sheet is present. At this point, the apparatus is placed in a state to permit its recording operation to start. The recording operation after, the recording for one page has been finished, will be terminated at the moment the end portion of that page is fed up to the discharging port 7 corresponding to its cutting position. Subsequent recording operation can be consecutively carried out as the sensor 4 is detecting the presence of the recording paper even after the recording operation is over. One example of the printer apparatus employing such a roll sheet as this will be explained in detail.

Figure 3:
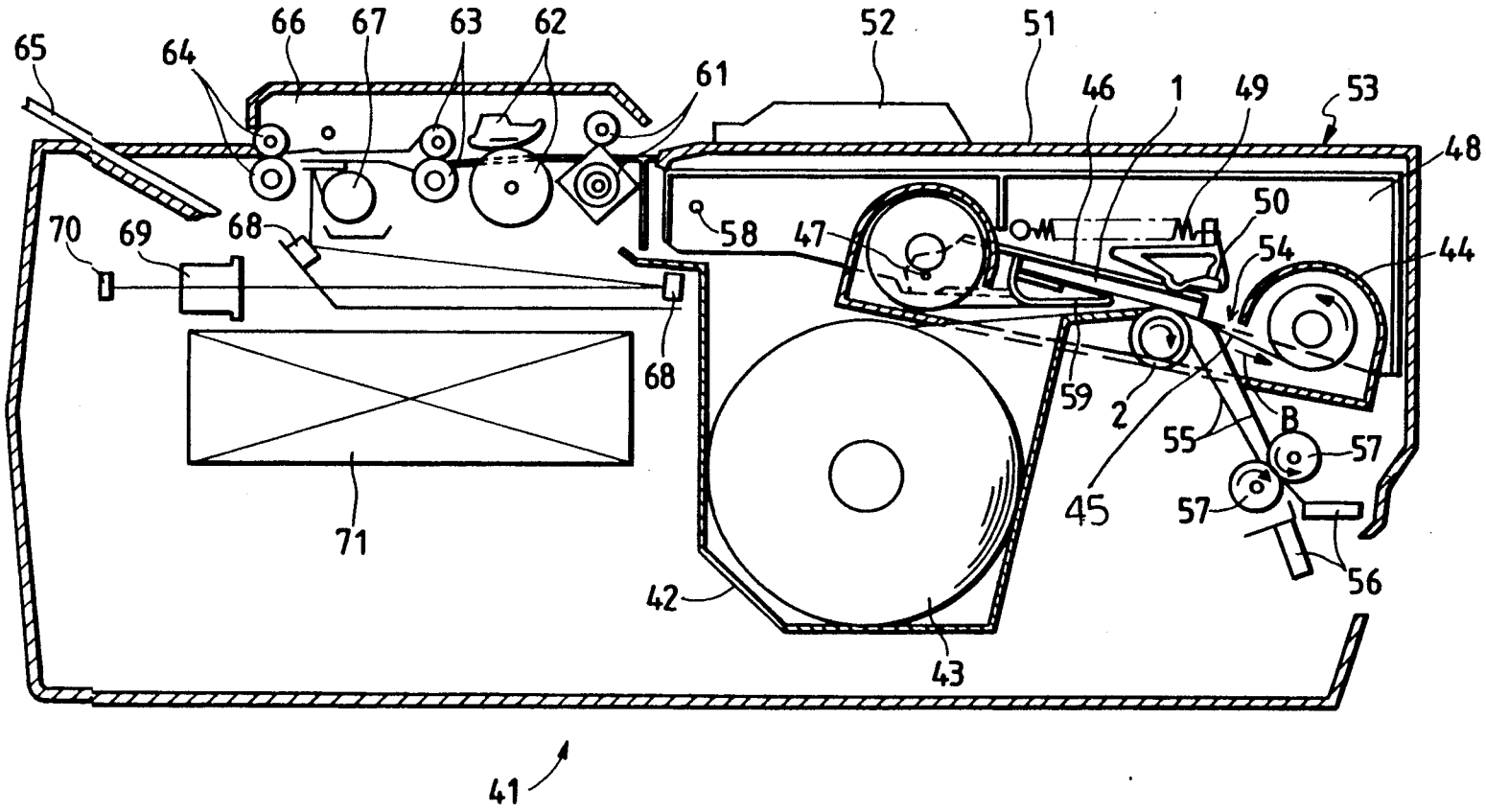
FIG. 3 is a side sectional view representing a structure of a facsimile apparatus employed as the recording apparatus of the embodiment.

Referring to FIG. 3, there is shown a side sectional view of a facsimile apparatus 41 employing the recording device (printer) according to the present embodiment. The printer section in this example is illustrated shown as a thermal transfer printer which performs recording on a recording sheet 43 using the thermal transfer method. The general construction of the printer used herein is fundamentally the same as that described previously with the exception that the thermal head 1 and the platen roller 2 are changed in arrangement.

The leading end of the recording sheet 43 wound a roll and accommodated in a recording sheet holder 42 and an ink sheet 45 of an ink sheet cassette 44 are pinched between the platen roller 2 and the thermal head 1. The thermal head 1 is fixed to a head holder 46. The head holder 46 is rotatably mounted to an upper base 48 with a fulcrum 47 of the holder as the center. Additionally, the thermal head 1 is pressed against the platen roller 2 by the biasing force of a head press arm 50 through a spring 49. A manuscript stand cover 51 is fixed to the upper base 48 and the cover 51 carries a manuscript width guide 52. The guide 52 is movably mounted so that it can be adjusted to the widths of given manuscripts.

In addition, the upper base 48 is mounted to an apparatus body frame 53 in such a manner that it can be rotated with the fulcrum 58 as a center. A guide 59 is used as a guide plate which leads the recording paper 43 and the ink sheet 45 up to the recording position by the thermal head 1, and on the inside of the guide 59 there is disposed a recording sheet sensor (not shown), similar to FIG. 1.

The ink sheet cassette 44 is configured so that, when set in such a recordable condition as shown in FIG. 3, a driving force required to wind up an ink sheet is provided thereto from a motor (not shown) disposed within the body frame 41. At the time of recording, when the platen roller 2 is rotated in the direction indicated by an arrow by means of the motor (not shown) on the body frame 41 side, the recording sheet 43 and the ink sheet 45 are conveyed in the direction indicated by an arrow "B", and the recording operation with thermal transfer method is performed in accordance with the information to be recorded at the recording position between the thermal head 1 and the platen roller 2. The recording sheet 43 and the ink sheet 45 are separated at a separation section 54 after the recording operation has finished and the ink sheet 45 is wound up within the cassette On the other hand, the separated recording sheet 43 is advanced or urged through between guide plates 55 and discharged by a pair of discharge rollers 57 driven by the motor (not shown) on the body 41 side, and cut off by a cutter 56 after all the recording processes are completed.

Manuscripts placed on the manuscript stand cover 51 are separated one by one at an ADF (automatic document feeder) section 61 and an ADF separation section 62, and conveyed by a pair of manuscript conveying rollers 63, and then discharged by manuscript discharge rollers 64 and stocked on a manuscript tray 65. At this time, the manuscript surface with information is irradiated with light from a fluorescent lamp 67 disposed at a reading section 66 between the manuscript conveying rollers 63 and the manuscript discharge rollers 64. The light reflected by the manuscript surface is deflected by mirrors 68 and focused on a photoelectric conversion element 70 through a lens 69. All the power required for the entire apparatus F is supplied from an electric power source 71.

Pressing by the thermal head 1 provided on the upper base 48 and the platen roller 2 may be released by lifting the upper base 48 upward in the condition shown in FIG. 3. Accordingly, the recording sheet 43 and the ink sheet cassette 44 can be exchanged when the ink sheet 45 and the thermal head 1 are released from pressing.

As clearly understood from the foregoing, since the protective cover for the thermal head is utilized so as to form a part of the recording sheet guide, and the recording sheet sensor is arranged on the inside thereof, the following advantages may be obtained:

(i) The apparatus may by made more compact;

(ii) Assembly may be facilitated due to simplification of the structure; and (iii) Cost may be reduced due to reduction in the number of parts.

Although embodiments of this invention have been described in detail herein with reference to the thermosensitive recording or thermal transfer utilizing the thermal head, it is to be understood that the invention is not limited thereto, and that, needless to say, it can be applied to an utilizing other recording systems.

As explained above, according to the present invention, there are provided such effects that the space efficiency or availability for a sensor as well as a guide member can be enhanced through curtailment of the number of parts which is attained by using a noble guide member integrally equipped with a sensor for detecting the presence or absence of the recording medium.

What it claimed:

1. A recording apparatus for recording by a recording head on a recording medium which is conveyed through a conveyance route, comprising:

a guide member for guiding said recording medium through the conveyance route, said guide member forming a protective cover for said recording head; and detection means provided on said guide member to detect a presence and absence of said recording medium in said conveyance route.

2. A recording apparatus according to claim 1, wherein said guide member has a surface facing said conveyance route and an open port section provided at said surface, and said detection means is provided at said open port section.

3. A recording apparatus according to claim 1, wherein said detection means comprises a photosensor for irradiating said recording medium on said conveyance route with light and detecting reflected light from said recording medium.

4. A recording apparatus according to claim 1, wherein said recording apparatus is a thermosensitive recording apparatus having a thermal head.

5. A recording apparatus according to claim 1, wherein said recording apparatus is a thermal transfer recording apparatus having a thermal head.

6. A recording apparatus according to claim 5, wherein said guide member is fixed to said recording head.

7. A recording apparatus according to claim 5, wherein said recording apparatus is a facsimile apparatus.

8. A recording apparatus for recording by a recording head on a recording medium which is conveyed through a conveyance route, comprising:

a guide member for guiding said recording medium through the conveyance route, said guide member being attached to said recording head; and detection means provided on said guide member to detect a presence and absence of said recording medium in said conveyance route.

9. A recording apparatus according to claim 8, wherein said guide member has a surface facing said conveyance route and an open port section provided at said surface, and said detection means is provided at said open port section.

10. A recording apparatus according to claim 8, wherein said detection means comprises a photosensor for irradiating said recording medium on said conveyance route with light and detecting reflected light from said recording medium.

11. A recording apparatus according to claim 8, wherein said recording apparatus is a thermosensitive recording apparatus having a thermal head.

12. A recording apparatus according to claim 8, wherein said recording apparatus is a thermal transfer recording apparatus having a thermal head.

13. A recording apparatus according to claim 8, wherein said recording apparatus is a facsimile apparatus.

14. A recording apparatus according to claim 6, wherein said guide member is commonly used as a protective cover for said recording head.

* * * * *

UNITED STATES PATENT AND TRADEMARK OFFICE

CERTIFICATE OF CORRECTION

PATENT NO. : 5,294,941

DATED : March 15, 1994

INVENTOR(S) : MASAKATSU YAMADA, ET AL.

It is certified that error appears in the above-identified patent and that said Letters Patent is hereby corrected as shown below:

COLUMN 1

Line 16, "conveyed" should read --conveyed.--.

COLUMN 2

Line 3, "completing" should read --complicating--.
Line 58, "referring" should read --referring to--.

COLUMN 3

Line 3, "an exhausting port 7." should read --a discharge port 7.--.
Line 53, "sheet" (second occurrence) should read --sheet.--.

COLUMN 4

Line 17, "in" should be deleted.
Line 43, "mean" should read --means--.
Line 61, "exhausting" should read --discharge--.

COLUMN 5

Line 7, "operation" (second occurrence) should read --operation,--.
Line 8, "after," should read --after--.
Line 20, "illustrated" should be deleted.
Line 27, "wound" should read --wound in--.
Line 65, "cassette" should read --cassette.--.

UNITED STATES PATENT AND TRADEMARK OFFICE

CERTIFICATE OF CORRECTION

PATENT NO. : 5,294,941

DATED : March 15, 1994

INVENTOR(S) : MASAKATSU YAMADA, ET AL.

It is certified that error appears in the above-identified patent and that said Letters Patent is hereby corrected as shown below:

COLUMN 6

Line 8, "stocked" should read --stacked--.
Line 29, "by" should read --be--.
Line 39, "an utilizing" should read --an electrophotographic printer or any kind of printer utilizing--.
Line 47, "it claimed:" should read --is claimed is:--.

COLUMN 7

Line 7, "claim 5," should read --claim 1,--.
Line 11, "claim 5," should read --claim 1,--.

COLUMN 8

Line 20, "claim 6," should read --claim 8,--.

Signed and Sealed this

Thirteenth Day of September, 1994

*Attest:*

*Attesting Officer*

Bruce Lehman

BRUCE LEHMAN

*Commissioner of Patents and Trademarks*